United States Patent [19]

Ochiai et al.

[11] Patent Number: 4,768,772

[45] Date of Patent: Sep. 6, 1988

[54] COPYING APPARATUS WITH FRONT LOADING PAPER SUPPLY CASSETTE

[75] Inventors: Yoshio Ochiai; Mamoru Umeki, both of Hachioji, Japan

[73] Assignee: Konishiroku Photo Industry Co., Ltd., Tokyo, Japan

[21] Appl. No.: 898,787

[22] Filed: Aug. 18, 1986

Related U.S. Application Data

[63] Continuation of Ser. No. 692,775, Jan. 18, 1985, abandoned.

[30] Foreign Application Priority Data

Jan. 18, 1984 [JP] Japan ..... 59-6935

[51] Int. Cl.[4] ..... B65H 1/04

[52] U.S. Cl. ..... 271/164; 271/127

[58] Field of Search ..... 271/127, 162, 164, 145; 242/55.19 A

[56] References Cited

U.S. PATENT DOCUMENTS

| | | | |
|---|---|---|---|
| 3,311,316 | 3/1967 | Williams | 242/55.19 A |
| 3,340,369 | 9/1967 | Seidl | 242/55.19 A X |
| 3,563,535 | 2/1971 | Vitù | 271/164 |
| 3,959,623 | 5/1976 | Nakahara | 271/164 X |
| 4,032,137 | 6/1977 | Katayama et al. | 271/164 |
| 4,219,192 | 8/1980 | Burke | 271/164 |
| 4,231,566 | 11/1980 | Suzuki | 271/164 |
| 4,275,969 | 6/1981 | Matsuhisa et al. | 271/164 |
| 4,329,589 | 5/1982 | Stievenart et al. | 271/164 X |
| 4,372,547 | 2/1983 | Yanagawa et al. | 271/164 |
| 4,402,498 | 9/1983 | Suzuki | 271/164 |
| 4,478,401 | 10/1984 | Shibuya | 271/164 |
| 4,496,273 | 1/1985 | Thate et al. | 271/164 |

*Primary Examiner*—H. Grant Skaggs
*Assistant Examiner*—Frederick R. Handren
*Attorney, Agent, or Firm*—Jordan B. Bierman

[57] ABSTRACT

The invention is an improved design for a paper supply cassette for use in a copying apparatus. The paper supply cassette includes an arrangement to settle the positional relation between the leading end of the copy paper inside the cassette and the paper supply mechanism within the copy apparatus. The copy paper cassette and copy apparatus designed to permit the insertion of the cassette into the apparatus without the necessity of having to open the front cover of the apparatus.

12 Claims, 4 Drawing Sheets

COPYING APPARATUS WITH FRONT LOADING PAPER SUPPLY CASSETTE

This Application is a continuation of application Ser. No. 692,775, filed Jan. 18, 1985, now abandoned, which claims the priority of Japanese No. 6935/84, filed Jan. 18, 1984.

BACKGROUND OF THE INVENTION

1. Field of the Invention

The present invention relates to a copying apparatus, and particularly to the improvement on the copying paper feeding mechanism of the copying apparatus.

2. Description of the Prior Art

As is well-known, in a desk-top-type copying apparatus, the paper-supply stream thereof is generally such that the apparatus has on one side of the body thereof a cassette-insertion opening and thereinside a paper-supply unit, and into the cassette-insertion opening is inserted a paper-supply cassette in the direction toward the opening from one appropriate side, and the paper-supply unit inside the body feeds each copying sheet in the same direction as the paper-supply cassette inserting direction. Accordingly, this system, since the paper-supply cassette inserting direction and the paper sheet feeding direction are the same, is advantageous in respect that just inserting a paper-supply cassette into the cassette-insertion opening results in the settling of the positional relation between the paper-supply unit and the leading end of a copying paper sheet, thus securing the feed of the copying paper sheet in a predetermined timing. This system, however, has the disadvantage that there must be an appropriate spacing on one side of the apparatus body for the insertion of the paper-supply cassette, therefore the body requires a large spacing for the installation thereof, and because of the need for handling the paper-supply cassette on the side face of the body, the efficiency of the machine operation is diminished.

For this reason, there has hitherto been proposed a construction (as disclosed in, for example, our Japanese Patent Application No. 81420/1983) which is such that a paper-supply cassette is inserted into the body from the front side (operator's side), and a copy image-printed paper is ejected from the body in a direction perpendicular to the direction in which the paper-supply cassette is inserted. That is, this construction, since it allows the loading/unloading operation of a paper-supply cassette to be carried out in front of the body, is advantageous in that if it requires no spacing on a side of the body, and thus a small spacing is enough for the installation of the apparatus body. This construction, however, has the drawback that, because a copying paper sheet is transported in a direction perpendicular to the direction in which a paper-supply cassette is inserted, there is present a play between the cassette-insertion opening and the paper-supply cassette, so that it is difficult to define the positional relation between the leading end of the copying paper inside the inserted paper-supply cassette and the paper-supply unit, causing the possibility of failure in feeding copying paper sheets, thus resulting in the difficulty in supplying copying sheets in a predetermined timing.

OBJECTS AND SUMMARY OF THE INVENTION

This invention has been made in view of the above problems lying in the above-described copying apparatus of the type of loading a paper-supply cassette from the front thereof.

It is therefore an object of the present invention to provide a copying apparatus of a construction that causes and secures the settling of the positional relation between the leading end of the copying paper sheet inside the loaded paper-supply cassette and the paper-supply means inside the apparatus body.

It is another object of the present invention to provide a copying apparatus which is so constructed as to allow a paper-supply cassette to be inserted thereinto, without removing the front cover thereof, from the outside of the cover.

A further object and features of the present invention will become apparent from the following illustration with reference to the accompanying drawings.

DESCRIPTION OF THE PREFERRED EMBODIMENT

Examples of the present invention will be illustrated in detail in accordance with the accompanying drawings.

Figure 1:
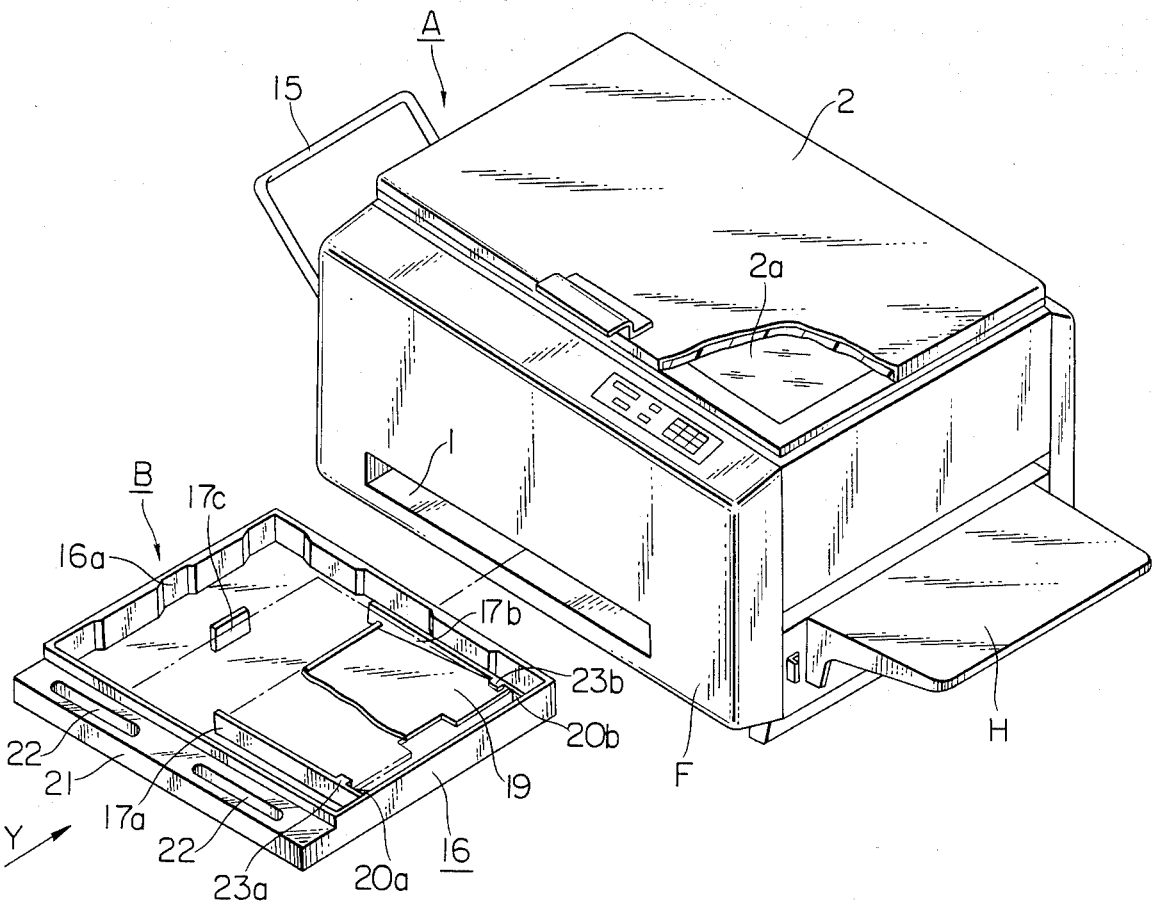
FIG. 1 shows overall perspective views of the copying apparatus and the paper supply cassette of the present invention.
Figure 2:
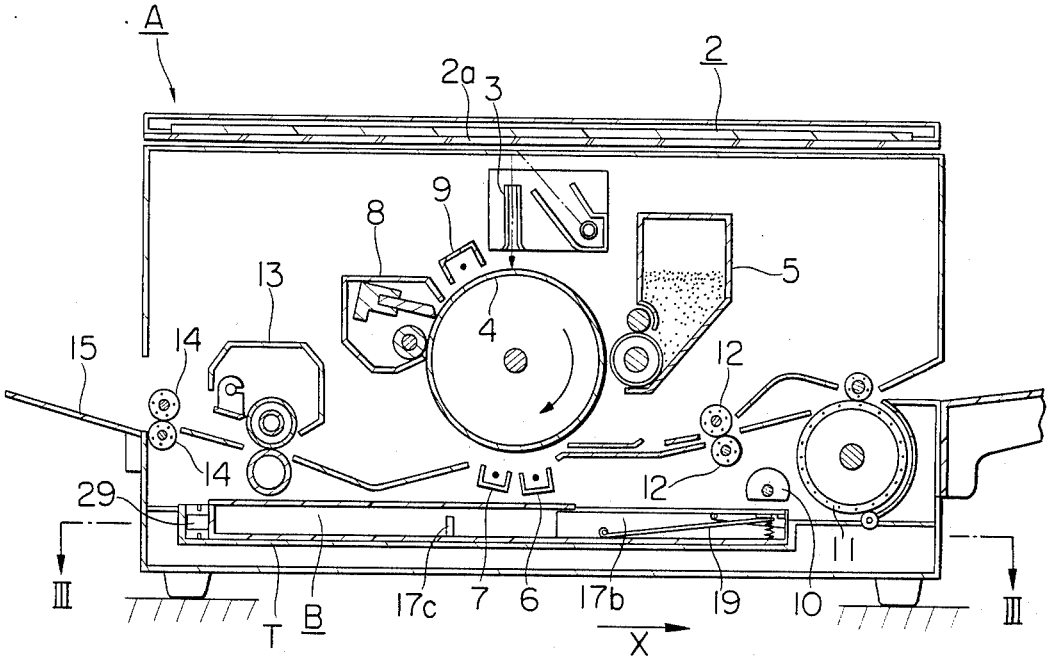
FIG. 2 is a schematic cross-sectional view of the copying apparatus with a paper-supply cassette loaded therein.
Figure 3:
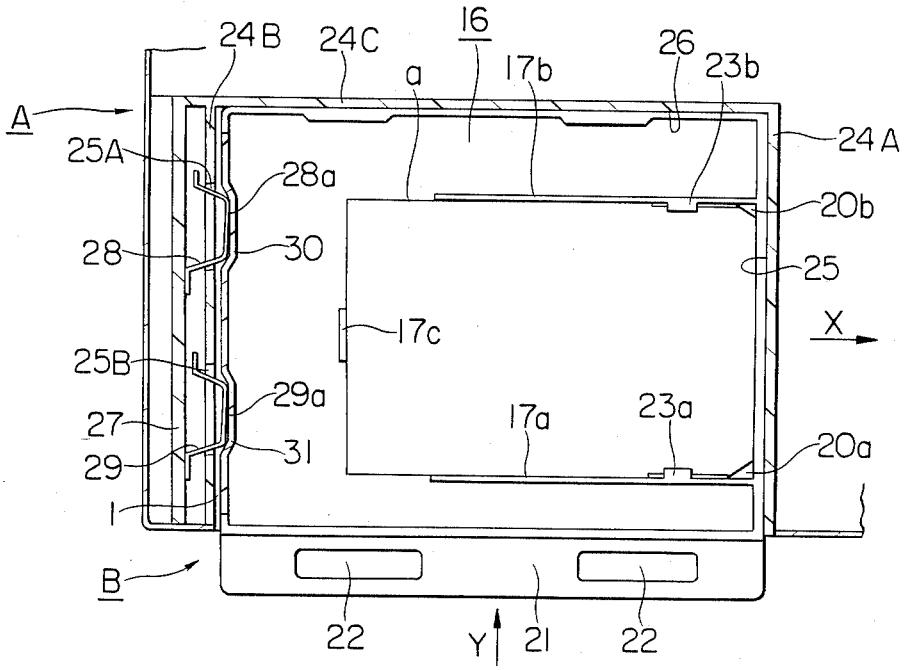
FIG. 3 is a cross-sectional view as seen in the direction of arrows from the line III—III of FIG. 2.

FIGS. 1 to 3 show the overall construction of the copying apparatus and the interrelation thereof with the paper-supply cassette. In the lower part of the front side cover F of the copying apparatus A is formed a paper-supply cassette B insertable cassette-insertion opening 1 that will be detailed hereinafter. The front side cover having the cassette-insertion opening is desirable to be openably/closably provided. The paper-supply cassette B, in which is loaded a plurality of copying paper sheets a, is inserted toward the inner part through the cassette-insertion opening 1. The cassette is slidingly moved on a cassette holding base T up to a given position. On top of the body A is provided a longitudinally reciprocatingly movable document glass plate 2. The image of a document placed on the platen glass 2*a* of the document glass plate 2 is focused by and through a distributed index lens 3, known as "Selfoc Lens" (manufactured by Nippon Sheet Glass Co., Ltd.), upon the entire area of a photoreceptor drum 4 located in the center of the body A. The electrostatic charge on the photoreceptor drum 4, which is in advance charged by a charging electrode 9, is locally annihilated or diminished to thereby form an electrostatic latent image corresponding to the document image. This electrostatic latent image is then processed in succession by known processing devices, i.e., developing device 5, image-transfer electrode 6, separation electrode 7, and cleaning device 8, which are all arranged around the photoreceptor drum 4. Each copying paper sheet a inside the paper-supply cassette B is drawn out by a paper-feed means, e.g., a crescent-shaped paper-feed roller 10, provided inside the body, in a direction X perpendicular to the direction Y in which the paper-supply cassette B is inserted. After that, the copying paper sheet a is U-turned by a large-diameter turning roller 11, which is disposed in the lower part of the body and in the downstream side of the foregoing paper feed roller, and by the transport means, such as a transport roller, guide plate, etc., arranged around in the proximity thereof, thereby to be transported up to the position of a timing roller (generally called "registration roller") 12. This timing roller 12 is driven synchronously with the circumferential speed of the photoreceptor drum 4, the said timing roller feeding a copying paper sheet a with its leading end toward the image-transfer electrode 6 at a timing speed matching the tip of the toner image formed on the circumferential area of the photoreceptor drum 4. The copying paper sheet a, onto which the toner image on the photoreceptor drum 4 has been transferred by the action of the imagetransfer electrode 6, is separated by the separation electrode 7 from the circumferential surface of the photoreceptor drum 4 thereby to be transported through a heat roller fixing device 13 and an ejection roller 14 out onto a copy-receiving tray 15. The paper-feed roller, after feeding each one of copying paper sheets, is desirable, for convenience's sake, to be always retained in such a condition as is shown in FIG. 2. The roller, of course, is allowed to be in the sectionally round form if it is arbitrarily constructed so as to be movable up and down in association with the loading and unloading of the foregoing cassette. The roller may also be so constructed as to be movable up and down by a lever operation. In any case, since the paper-feed roller is outside the feature of the present invention, no further description about the roller will be made. A planar member H that is provided in the opposite side of the body to the foregoing copy-receiving tray is a table for use in manually inserting one by one copying paper sheets.

Figure 4:
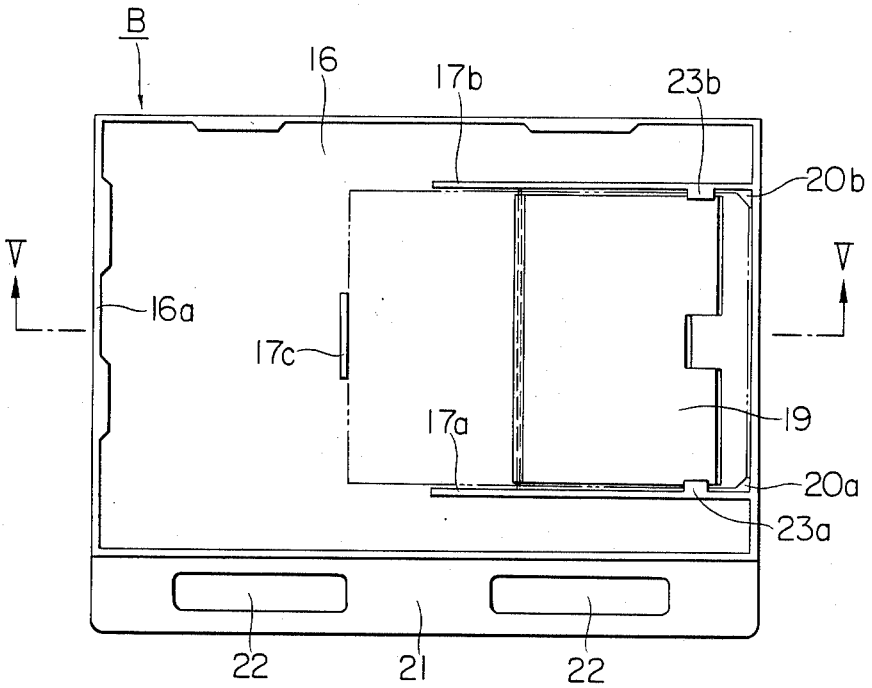
FIG. 4 is a plan view of the paper-supply cassette.
Figure 5:
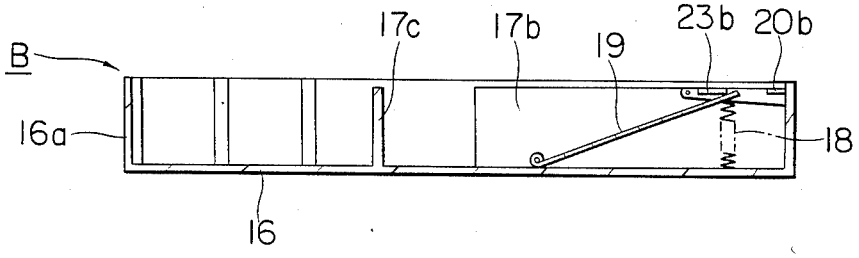
FIG. 5 is a cross-sectional view as seen in the direction of arrows from the line V—V of FIG. 4.

FIGS. 4 and 5 are a plan view and a cross-sectional view, respectively, of the paper-supply cassette B. The paper-supply cassette B includes a cassette body 16 in the thin, rectangular box form with its top open. The cassette body 16 has thereinside three paper position-regulating plates 17*a*, 17*b* and 17*c* posted facing in the three directions. These regulating plates are movably provided, but may, of course, be provided fixedly. The paper position regulating plates 17*a* and 17*b*, extending in the direction of feeding copying sheets, have therebetween an inter-plate 19 which can pivot about its foot as an axis supported by the bottom wall of the cassette body 16 and which is resiliently biased upward by a spring 18 that is interposed between the inner-plate and the bottom wall. Also, the foregoing paper position-regulating plates 17*a* and 17*b*, in parallel with each other, have at their ends and in their sides facing opposite to each other a pair of separation claws 20*a* and 20*b*, respectively, which serve to separate the topmost one copying paper sheet from the others underneath the same. The paper-supply-cassette B has on the far side of the body 16 from its inserting direction a grip 21 formed as an integral part of the body. The grip 21 is adapted to be caught by hand for handling the paper-supply cassette B when inserting it in and when pulling it out of the apparatus body A. That is, the grip 21, in the example shown in FIG. 4, is constructed so as to be a thick apron-like wall extended out on one side of the cassette body 16. Since the grip 21 has thereon a pair of recesses or therein a pair of slots provided for the purpose of putting fingers therein, when inserting the paper-supply cassette B into the cassette-insertion opening 1, the paper-supply cassette B is strongly pushed in at its rear side with respect to its inserting direction by applying finger tips thereto, whereby the paper-supply cassette B can be adequately pushed into the body A. When drawing the paper-supply cassette B from the body A, the grip 21, positioned outside the cassette-insertion opening 1, is gripped by hand to pull the paper-supply cassette B toward the front side (operator's side), whereby the paper-supply cassette B can be pulled out of the body A. The grip 21, of course, is not necessarily required to be formed as an integral part of the cassette body 16. For example, the grip 21 is allowed to be a metallic or plastic handle mounted to the rear of the paper-supply cassette B with respect to its inserting direction, i.e., to the part thereof facing the operator. Alternatively, if the cassette B is so designed as to have its width large enough to be partially extended out of the apparatus A, the extended out part can be utilized for inserting and pulling out the cassette body. The term "grip" used herein includes all these embodiments. In addition, protrusions 23*a* and 23*b*, which are the top parts of the regulating plates 17*a* and 17*b*, respectively, and extend inwardly inside the cassette, are stoppers to prevent the copying paper sheets held inside the cassette from floating or getting out of the cassette.

Figure 6:
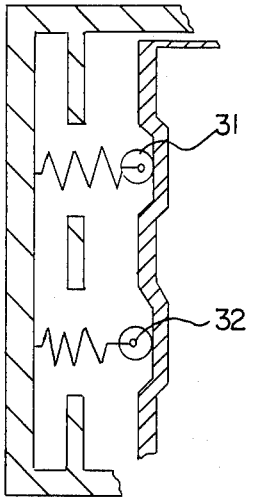
FIG. 6 shows an alternative arrangement for latching the paper supply cassette in the copying apparatus.

In order to define the positional relation between the previously mentioned paper-feed means, i.e., the paper-feed roller 10, and the leading end of copying paper sheet a, in the example, a construction as shown in FIG. 3 is adopted. FIG. 3 is a cross-sectional view of the inside of the cassette-insertion opening 1 as seen in the direction of arrows from the line III—III of FIG. 2. The internal side wall of the cassette-insertion opening 1, viewing from the copying paper feeding side, is comprised of retaining means in the form of a first portion or front wall 24A, second portion or rear wall 24B and side wall 24C. The internal face 25 of the front wall 24A, to serve as the cassette stopper for defining the leading end of copying paper sheet a in the feeding direction, and the internal face 26 of the side wall 24C, to serve as the cassette stopper for defining the inserting depth of copying paper sheet a, are so constructed as to come in contact with the external faces of the corresponding walls of the cassette (hereinafter detailed). And the rear wall 24B has therein two openings 25A and 25B. Through the openings 25A and 25B the heads of pressure means such as, for example, the heads of U-shaped plate springs 28 and 29, respectively, emerge from the bracing wall 27, the said U-shaped plate-springs being provided so that the heads thereof are protrusible and sinkable, and being fixed at their feet to the bracing wall 27, which is positioned in parallel with and outside the rear wall 24B. On the other hand, the rear wall 16*a* of the cassette body 16 has thereon recesses 30 and 31 formed for having the foregoing heads of the plate springs 28 and 29 fall thereinto. Accordingly, when inserting the paper-supply cassette B into the cassette-insertion opening 1, the paper-supply cassette B is pressed by the plate springs 28 and 29 against the internal face 25 of the front wall 24A. As a result, the leading end of the copying paper sheet a inside the paper-supply cassette B becomes placed precisely in a given position with respect to the paper-feed roller. In other words, the positional relation between the leading end of the copying paper sheet and the paper-feed roller can be always kept constant, so that each one of the copying paper sheets inside the cassette can be stably fed by the paper-feed roller 10. Also, when the paper-supply cassette B is properly inserted into the cassette-insertion opening 1, the heads 28*a* and 29*a* of the plate springs 28 and 29 fall into the recesses 30 and 31 of the cassette body 16, so that the fall of the heads retains the paper-supply cassette and prevents the paper-supply cassette B from getting out of the cassette-insertion opening 1 due to a possible swing of the apparatus body A, to thereby prevent a change in the positional relation between the paper-feed roller 10 and the leading end of the copying paper sheet a. The construction of the foregoing pressure means, of course, is not limited to that illustrated in FIG. 3. The construction, for example, may also be such that a pressure plate supported by a plurality of coil springs or plate springs is adapted to press on the paper-supply cassette, or a ball or roller 31,32 biased by an arbitrary resiliently-biasing means, as shown in FIG. 6, is used to press on the paper-supply cassette. In addition, such pressure means may also be mounted to the reverse position to that mentioned above.

As is apparent from the above description, the copying apparatus in this invention allows not only the saving of the spacing for the installation thereof but also the expectation of such excellent paper feed that, because the cassette can be firmly set, the positional relation between the paper-feed means and the copying paper sheet is securely retained, minimizing the possibility of failure in feeding copying paper sheets.

We claim:

1. A copying apparatus having an opening through which a cassette is inserted into the apparatus in a first direction comprising:

a transport means in the apparatus for transporting a copy sheet being stored in the cassette in a second direction perpendicular to the first direction, a retaining means for retaining the cassette in a predetermined position in the apparatus, said retaining means having at least one first portion which abuts said cassette and prevents said cassette from advancing toward said second direction, pressure means for resiliently pressing said cassette toward said second direction, whereby said cassette abuts with said first portion.

2. The copying apparatus of claim 1, wherein said copying apparatus comprises a front cover having the opening.

3. The copying apparatus of claim 2, wherein said front cover is openable and closable with respect to the body of said copying apparatus.

4. The copying apparatus of claim 1, wherein the first portion is a wall-like member.

5. The copying apparatus of claim 1, wherein said pressure means are plate springs.

6. The copying apparatus of claim 1, wherein said pressure means is a roller resiliently biased in the second direction.

7. The copying apparatus of claim 6, wherein said roller is rotatable when said cassette is inserted into and drawn out of said opening.

8. The apparatus of claim 1, wherein said retaining means further comprising a second portion which prevents said cassette from advancing toward said first direction.

9. The apparatus of claim 1 wherein said cassette has at least one recess.

10. The apparatus of claim 9 wherein said pressure means and said recesses are complementary whereby the cassette is locked latched in said apparatus.

11. The apparatus of claim 1 wherein said first portion is placed so that the front wall of the cassette contacts said first portion, said first wall comprising the wall of said cassette located furthest upstream in the paper feeding path.

12. The apparatus of claim 11 wherein said pressure means presses against the rear wall of the cassette, said rear wall comprising the wall of said cassette located furthest downstream in the paper feeding path.

* * * * *